US007014302B2

(12) United States Patent
Ujita et al.

(10) Patent No.: US 7,014,302 B2
(45) Date of Patent: Mar. 21, 2006

(54) INK JET RECORDING APPARATUS

(75) Inventors: Toshihiko Ujita, Kanagawa (JP); Junji Shimoda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 10/716,736

(22) Filed: Nov. 17, 2003

(65) Prior Publication Data

US 2004/0100539 A1 May 27, 2004

(30) Foreign Application Priority Data

Nov. 27, 2002 (JP) ..... 2002-343928

(51) Int. Cl.
*B41J 2/175* (2006.01)

(52) U.S. Cl. ..... 347/85

(58) Field of Classification Search ..... 347/84–87, 347/22, 29–35, 89

See application file for complete search history.

(56) References Cited

U.S. PATENT DOCUMENTS 5,847,736 A * 12/1998 Kanbayashi et al. ..... 347/89
6,820,973 B1 * 11/2004 Ujita ..... 347/85

FOREIGN PATENT DOCUMENTS

JP 6-255121 A 9/1994
JP 2000-296624 A 10/2000

* cited by examiner

*Primary Examiner*—K. Feggins
(74) *Attorney, Agent, or Firm*—Morgan & Finnegan, LLP

(57) ABSTRACT

An ink jet recording apparatus includes a sub tank unit mounted to a carriage, and an ink supply recovery unit. In the sub tank unit, a recording head and a sub tank are mounted to the carriage. The ink recovery unit has a main tank, and is connected with the sub tank unit via a supply joint, so as to be capable of supplying ink from the main tank to the sub tank. The sub tank houses an ink absorber having a lot of cavities for holding the ink, and an average distance between cavities is 0.12 mm to 0.25 mm.

1 Claim, 7 Drawing Sheets

INK JET RECORDING APPARATUS

BACKGROUND OF THE INVENTION

1. Field of the Invention

The present invention relates to an ink jet recording apparatus.

2. Related Background Art

Conventionally, many methods of supplying ink to a recording head which are used in ink jet recording apparatus are suggested and are in practical use.

One of the ink supplying methods is a method of supplying ink from an ink tank via a tube to a recording head. The ink jet recording apparatus are equipped with a recording head on their carriages which reciprocate, and mainly adopt a so-called serial scanning system for carrying out recording while the recording head is being reciprocated. For this reason, in the method of supplying ink via the tube, flow of the ink in the tube is influenced by the moving of the carriage, discharge of the ink from the recording head becomes unstable. For this reason, according to heightening of a recording speed, a unit for suppressing oscillation of the ink in the tube is necessary.

Further, the tube whose length is not less than a moving length of the carriage is necessary, and thus a space where the tube can move is secured in the device. This causes enlargement of the device. Air is occasionally mixed into the tube as long time passes, and thus in order to avoid a failure due to this, a tube material tends to have narrow selectivity, and become expensive. When a recovery operation is performed in order to exhaust the air in the tube, a large quantity of the ink which is not used for recording is moved from an ink supply source such as an ink tank. This causes an increase in useless ink and thus deteriorates cost-effectiveness.

In recent years, such a tube is eliminated, and a so-called on-carriage system (hereinafter, it is also described as a head tank on-carriage system) is invented, and it is in practical used in various forms. The head tank on-carriage system uses a cartridge 102 which is provided detachably to a carriage 101 in a form that a recording head is integral with an ink tank (the recording head and the ink tank are integral or can be separated from each other) as shown in FIG. 7.

The on-carriage system has an extremely simple constitution, and since an ink supply passage is included in the cartridge 102, the ink jet recording apparatus can be miniaturized and its cost can be reduced. Moreover, the ink supply passage can be designed to be short, and a number of portions where a moving direction of the carriage and a supply direction of the ink match with each other is extremely small. For this reason, unstable discharge due to oscillation of the ink at the time of high-speed recording can be greatly improved.

When the ink jet recording apparatus are, however, tried to be loaded with a large quantity of ink, a capacity of the ink tank necessarily becomes large, and the increase in the capacity of the ink tank increases a weight of the carriage in the head tank on-carriage system. When the weight of the carriage increases, a driving load of the carriage increases, and thus a driving source such as a carriage driving motor is enlarged. As a result, the ink jet recording apparatus is also enlarged. Moreover, the enlargement of the driving source causes an increase in power consumption.

On the other hand, in small-size ink jet recording apparatus, a size of a carriage becomes small, and thus a quantity of ink to be loaded into the carriage becomes extremely small. As a result, such a defect that a user should frequently replace an ink tank with a new one is estimated. When the ink tank is frequently replaced with new one, a lot of used ink tanks should be discarded. This becomes a problem to be solved because this does not go with the current of the time that environmental conservation is pursued.

A constitution shown in FIG. 8, namely, an intermittent ink supply system (hereinafter, it is simply described as a pit-in system) is, therefore, devised as a unit which solves the problem. In this system, a carriage 112 which is guided to a guide shaft 111 of a printer is equipped with a recording head 113 and a sub tank 114, a main tank 115 is provided separately from the sub tank 114, and the main tank 115 and the sub tank 114 are connected in a predetermined position if necessary so that the sub tank 114 is replenished with necessary ink from the main tank 115.

According to the pit-in system, since the weight of the carriage 112 can be lightened, the carriage 112 can be moved at high speed. Further, since the main tank 115 which houses ink to be supplied to the sub tank 114 is provided, a quantity of the ink to be loaded into the ink jet recording apparatus can be increased to the extent permitted by a space without influencing the weight of the carriage 112. Moreover, it is not necessary to connect the sub tank 114 and the main tank 115 using a tube, the constitution of the device becomes very simple.

The most important technical point in the pit-in system is to supply ink to the sub tank without a problem. That is to say, the most important element technique is how to control the supply of ink until the sub tank 114 is full when the sub tank 114 is connected with the main tank 115.

As one example of this technique is a method of arranging a sensor, for detecting a quantity of the ink in the sub tank, into the sub tank, and detecting a quantity of the ink to be suppliable to the sub tank at the time of pit-in so as to control a supply system of the ink. The mechanism for this method, however, becomes very complicated, delicate and expensive.

Another example is a method disclosed in Japanese Patent Application Laid-Open Nos. 2000-334979 and 2000-334982. In this method, when intermittent supply is carried out, the whole ink in the sub tank is once drafted, and a certain constant quantity of the ink corresponding to the capacity of the sub tank is supplied to the sub tank. According to this method, it is not necessary to add a device or a mechanism for detecting an ink quantity in the sub tank, but a total quantity of the discarded ink exhausted every time of the intermittent supply becomes huge. For this reason, it is necessary to enlarge a reservoir portion for the discarded ink, and thus when an ink jet recording apparatus is desired to be miniaturized, constraint on design becomes large.

As a technique which solves such a problem, therefore, it is suggested that a vapor-liquid separating film is arranged in the sub tank. The ink jet recording apparatus adopting the pit-in system using the vapor-liquid separating film is explained below with reference to FIGS. 9A and 9B.

As shown in FIGS. 9A and 9B, a sub tank unit 120 has a recording head 121 having a plurality of nozzles for discharging ink based on a control signal, and a sub tank 122 for holding the ink to be supplied to the recording head 121. The sub tank unit 120 is provided with a hollow ink supply needle 126 so that its root is positioned in the sub tank 122, and with a suction passage 124 for connecting an inside of the sub tank 122 with an outside so that the suction passage 124 is connected with the sub tank 122. A boundary portion between the suction passage 124 and the sub tank 122 is provided with a vapor-liquid separating film 125 having such a property that it does not allow liquid to pass but allows vapor to pass. Further, the sub tank 122 houses an ink absorber 123, and the ink is held in a state that it is absorbed by the ink absorber 123 in the sub tank 122. The sub tank unit 120 may be provided integrally with a carriage, not shown, or may be provided detachably from the carriage.

As the ink absorber 123, a polypropylene fiber material which is disclosed in Japanese Patent Application Laid-Open No. 2000-296624 is used because it is chemically stable and its cost is inexpensive. Moreover, as disclosed in Japanese Patent Application Laid-Open Nos. H6-255121 and H6-255121, density of the ink absorber 123 composed of the fiber material is set to 0.06 to 0.15 g/cm$^3$ which is suitable for holding the ink.

On the other-hand, an ink supply recovery unit 130 is fixed to an arbitrary position of the ink jet recording apparatus so as to be separated from the sub tank unit 120. The ink supply recovery unit 130 includes a main tank 131 for housing ink to be supplied to the sub tank 122, and a pump 132 for forcibly sucking air and/or ink from the inside of the sub tank unit 120. The pump 132 is connected with a discarded ink reservoir 133 for housing the ink sucked from the sub tank unit 120.

In a home position of the carriage, a cap 134 is arranged in a position opposed to the recording head 121, and a suction joint 135 is arranged in a position opposed to a suction socket 124*a* of the suction passage 124. Further, a supply joint 136 is arranged in a position opposed to the ink supply needle 126.

The cap 134 caps the recording head 121 at the time of an recovery operation of the recording head 121 and a non-operation of the ink jet recording apparatus, and is it is connected with the pump 132. The suction joint 135 is connected with the suction socket 124*a* at the time of the ink supply to the sub tank 122, and it is connected with the pump 132. The supply joint 136 is connected with the ink supply needle 126 at the time of the ink supply to the sub tank 122, and it is connected with the main tank 131. The suction joint 135 and the supply joint 136 can be operated independently from the cap 134.

At the time of a normal recording operation, as shown in FIG. 9A, the sub tank unit 120 and the ink supply recovery unit 130 are separated from each other, and while the carriage is being moved, the recording head 121 discharges the ink so that the recording is carried out.

At the time of non-recording, the carriage moves to the home position, and the cap 134 caps the recording head 121. As a result, the ink from the recording head 121 is prevented from evaporating. Moreover, at the time of the recovery operation of the recording head 121, while the cap 134 caps the recording head 121, the pump 132 is driven, so that the ink is forcibly sucked from the recording head 121. As a result, ink whose viscosity increases and foreign matters are removed from the insides of the nozzles of the recording head 121, and thus the insides of the nozzles are maintained clean.

Further, when the ink is supplied to the sub tank 122, as shown in FIG. 9B, the suction joint 135 and the supply joint 136 are connected with the suction socket 124*a* and the ink supply needle 126, respectively, and in this state, the pump 132 is driven. As a result, only air is sucked out of the sub tank 122 due to the property of the vapor-liquid separating film 125. Since a negative pressure in the sub tank 122 accordingly become high, the ink in the main tank 131 is sucked into the sub tank 122, and thus the ink is supplied to he sub tank 122.

According to the constitution which sucks the air in the sub tank 122 using the property of the vapor-liquid separating film 125 and supplies the ink into the sub tank 122, when a quantity of suction by the pump 132 is not less than an internal capacity of the sub tank 122, only air is sucked out of the sub tank 122 regardless of a quantity of the ink remaining in the sub tank 122. Further, the ink is supplied from the main tank 131 until the sub tank 122 is filled. Since the sub tank 122 can be filled only by sucking air whose quantity is not less than a certain quantity from the sub tank 122, it is not necessary to control a suction quantity. The sub tank 122 can be, therefore, replenished with the ink easily on principle.

When the constitution using the vapor-liquid separating film is applied to actual ink jet recording apparatus, however, the following problems arise.

In the pit-in system, the ink sucked into the sub tank is temporarily held by the ink absorber. A quantity of the ink to be held is determined by a product concept of the ink jet recording apparatus and a balance of the entire system but is not determined physically. For example, as to a small-size ink jet recording apparatus which is suitable to adopt the ink supply system using the pit-in system, a card-size printer is considered as an example.

The ability of the recording head is supposed such that an arrangement pitch of the nozzles is 1200 dpi and a discharge ink volume per 1 dot is 4.5 pl. When such a recording head is used so as to carry out predetermined printing on a whole surface of a card-size sheet (about 54 mm×85 mm), ink of about 0.07 ml is necessary. When an quantity of ink to be consumed by a process for stabilizing the discharge of ink, such as preliminary discharge and a recovery operation, is added to the ink of about 0.07 ml, the ink of about 0.083 ml is actually necessary for one sheet. That is to say, the ink of 0.083 ml as a precise amount per one sheet should be prepared for the ink absorber.

According to experiments by the inventors and the others, a volume of the ink absorber should be about 1.4 times as large as the volume of the ink to be held. That is to say, in order to enable the ink absorber to hold the ink of 0.083 ml, the volume of the ink absorber may be 0.12 ml.

While the consumption and supply of the ink are repeated, however, air is not replaced by the ink and remains in the sub tank and thus a capacity of the air increases. A quantity of storable ink (a quantity of suppliable ink) gradually reduces, and finally it is found that the ink of a quantity necessary for printing onto one sheet cannot be secured in the sub tank. In order to prevent this, a volume of the ink absorber may be enlarged so as to have sufficient margin, but this does not meet the original object of the pit-in system. Further, such a problem that a supply quantity of the ink gradually reduces is not limited to the case where the vapor-liquid separating film is used, and arises in all the ink jet recording apparatus in which the sub tank houses the ink absorber.

SUMMARY OF THE INVENTION

It is, therefore, an-object of the present invention to supply ink to a sub tank stably even when consumption and supply of the ink are repeated without obstructing miniaturization of the sub tank mounted onto a carriage in an ink jet recording apparatus for supplying ink according to a pit-in system.

In order to achieve the above object, the inventors and the others examine the cause that a quantity of ink supply to the sub tank gradually reduces. As the ink supply is repeated, bubbles adhere to an ink absorber, and thus it is found that the bubbles causes the reduction in a quantity of the ink to be absorbed by the ink absorber. When the bubbles adheres to the ink absorber, the bubbles are very firmly fixed due to surface tension of the ink, and it is not easy to remove the adhering bubbles. For example, the inventors and the others tried to remove the bubbles using decompression or allow the bubbles to flow using excessive ink flow. A sufficient effect, however, cannot be obtained. The inventors and the others examined a constitution of the ink absorber such that the bubbles are not removed but the bubbles are difficulty generated. Density of the ink absorber, namely, a size of a cavity portion is set suitably, so that an environment that the bubbles difficultly remain can be structured, and a pit-in system is adopted so that the ink supply which is carried out repeatedly can be stable.

That is to say, an ink jet recording apparatus includes: a carriage equipped with a recording head for discharging ink and a first ink tank for housing ink to be supplied to the recording head; and a second ink tank which is-arranged separately from the first ink tank and is connected with the first ink tank in order to supply the ink to the first ink tank, wherein an ink absorber having a lot of cavities for holding the ink is arranged in the first ink tank, and an average distance between cavities is 0.12 mm to 0.25 mm.

In the ink jet recording apparatus of the present invention, when the average distance between cavities is set to 0.12 mm to 0.25 mm, while negative pressure suitable for holding the ink is being generated, accumulation of the negative pressure generated in the ink absorber at the time of the ink supply from the second ink tank is suppressed. As a result, even if the ink supply from the second ink tank to the first ink tank is repeated, deterioration of an ink holding ability of the ink absorber is suppressed, thereby stably supplying the ink from the second ink tank to the first ink tank.

DETAILED DESCRIPTION OF THE PREFERRED EMBODIMENTS

An embodiment of the present invention is explained below with reference to the drawings.

Figure 1:
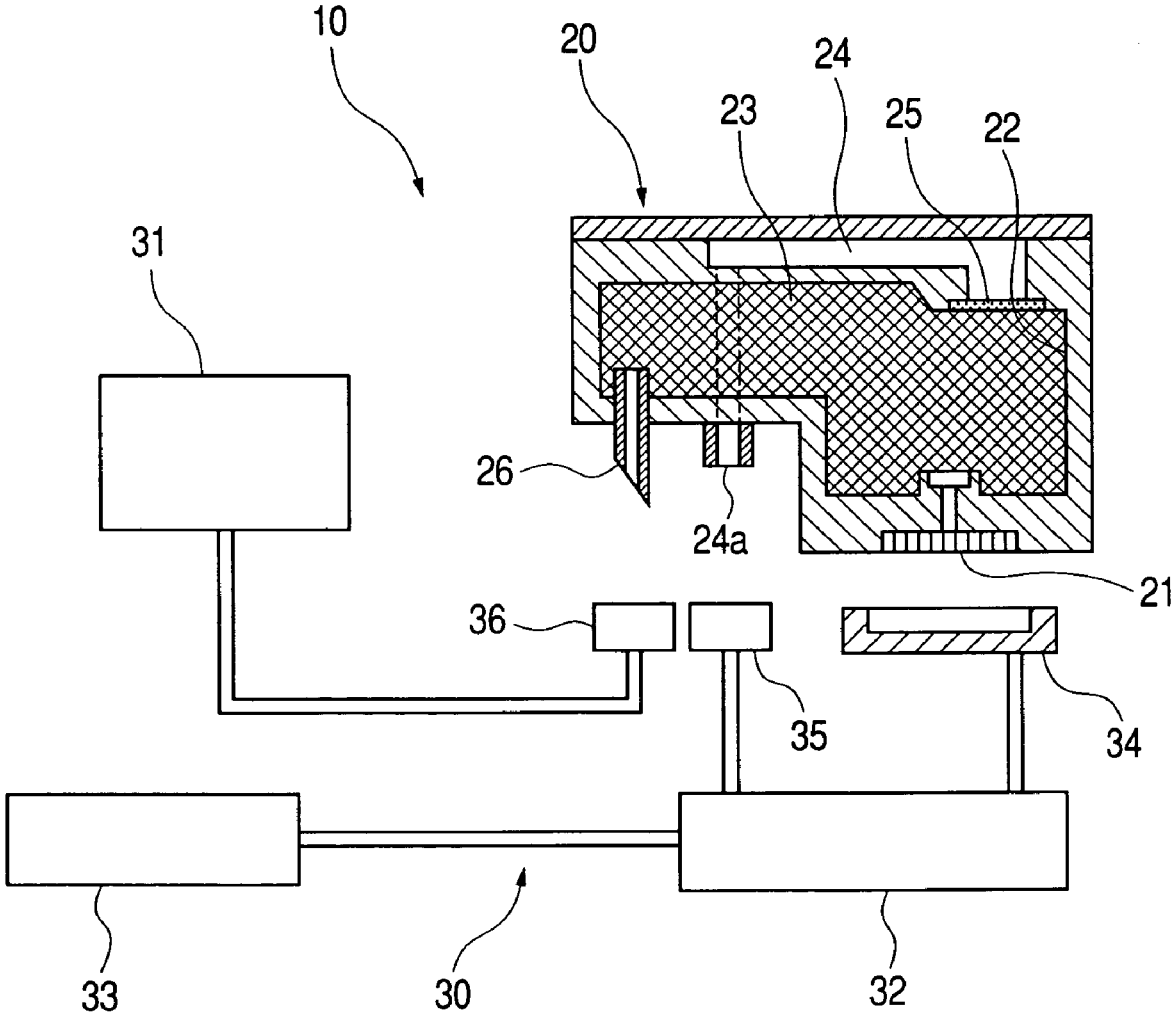
FIG. 1 is a schematic constitutional diagram of an ink jet recording apparatus according to one embodiment of the present invention.

FIG. 1 is a schematic constitutional diagram of an ink jet recording apparatus according to one embodiment of the present invention.

As shown in FIG. 1, the ink jet recording apparatus 10 includes a sub tank unit 20 having a recording head 21, a sub tank 22 and the like, and an ink supply recovery unit 30 having a main tank 31, a pump 32 and the like as main components. The sub tank unit 20 is mounted onto a carriage (not shown) which is reciprocated integrally or detachably. While a sheet is being transferred according to a predetermined pitch and the carriage is being reciprocated repeatedly by a sheet transfer mechanism (not shown), ink is discharged from the recording head 21, so that recording is carried out on the sheet. As the ink discharge system of the recording head 21, an arbitrary discharge system, which is known as general ink jet recording system using electrothermal elements or piezoelectric elements, can be used. In this specification, the recording means not only recording of characters, symbols and the like but also drawing of image data, patterns and the like.

Figure 9A:
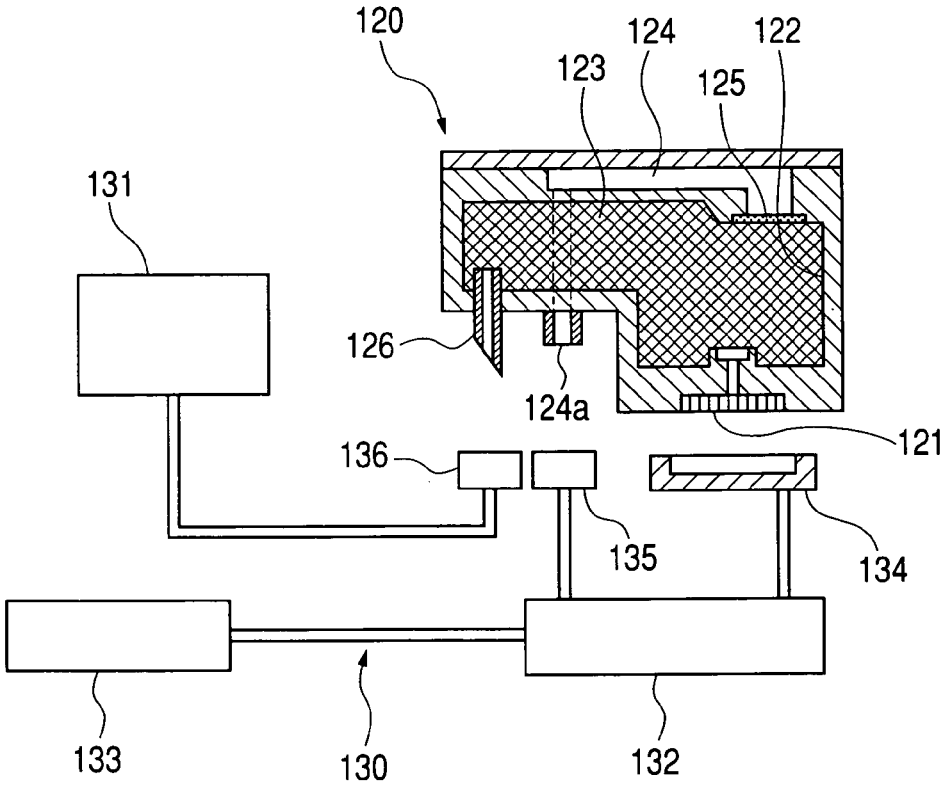
FIGS. 9A and 9B are diagrams for explaining an operation for supplying ink to a sub tank in the ink jet recording apparatus adopting the pit-in system using a vapor-liquid separating film.
Figure 9B:
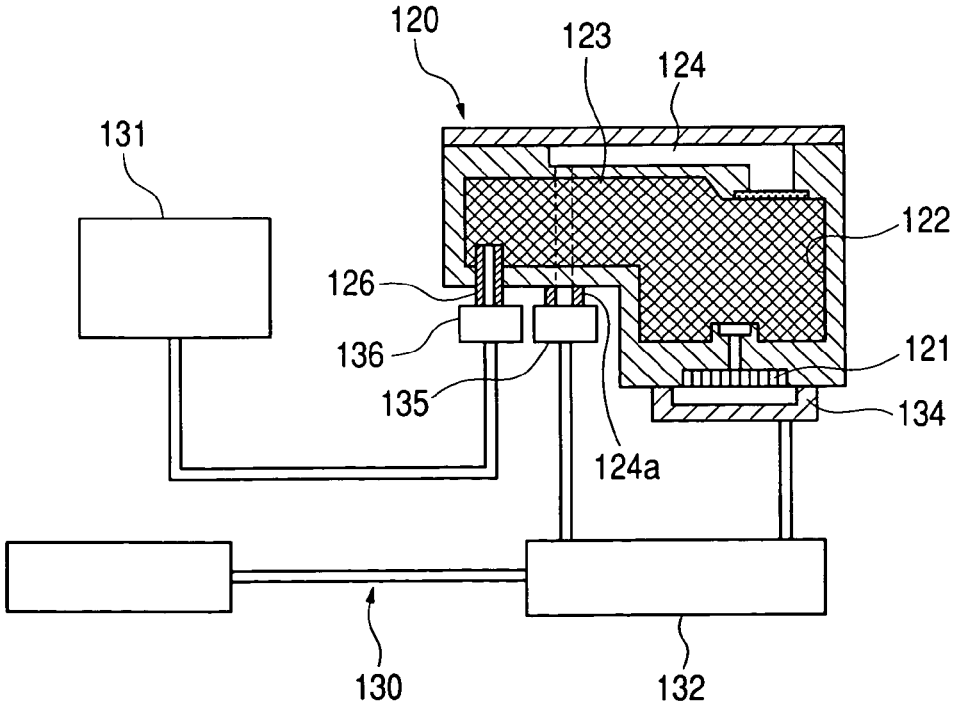

The sub tank unit 20 includes a suction passage 24 whose one end is a suction socket 24*a*, a vapor-liquid separating film 25, and an ink supply needle 26 as well as the recording head 21 and the sub tank 22. Further, the ink supply recovery unit 30 includes a discarded ink reservoir 33, a cap 34, a suction joint 35, and a supply joint 36 as well as the main tank 31 and the pump 32. The ink supply recovery unit 30 is normally separated from the sub tank unit 20, but when ink is supplied to the sub tank 22, the main tank 31 is connected with the sub tank unit 20. Since their constitution, arrangement, functions and operations are similar to those shown in FIGS. 9A and 9B, the explanation thereof is omitted here.

The most important characteristic of the present invention is that a dimension of a cavity of the ink absorber 23 arranged in the sub tank 22 is prescribed so that an average distance between cavities falls within a range of 0.12 mm to 0.25 mm. The ink absorber 23 has a lot of cavities, and the ink is held in the cavities, so that the ink is absorbed into the ink absorber 23. In this embodiment, a fiber material is used as the ink absorber 23, and the cavities in this case are arranged by gaps between fibers. That is to say, when the fiber material is used as the ink absorber 23, the average distance between cavities is prescribed as an average distance between fibers.

As the fiber material to be used for the ink absorber 23, polyolefin such as polypropylene and polyethylene which is generally used in industrial fields can be used. Moreover, as to a thickness of the fibers to be used for the ink absorber 23, the fibers whose fineness is 2 denier (18 g/km) to 7 denier (63 g/km) are generally used. In this embodiment, as the ink absorber 23, the fiber material made of polypropylene is used, and the sub tank 22 is charged with the ink absorber 23 so that the average distance between fibers falls within a range of 0.12 mm to 0.25 mm. More concretely, the polypropylene fibers with specific gravity $\rho$ of 0.91 and fineness of 6 denier (54 g/km) are housed in the sub tank 22 with packing density of 0.04 g per space of 1 $cm^3$.

Figure 2:
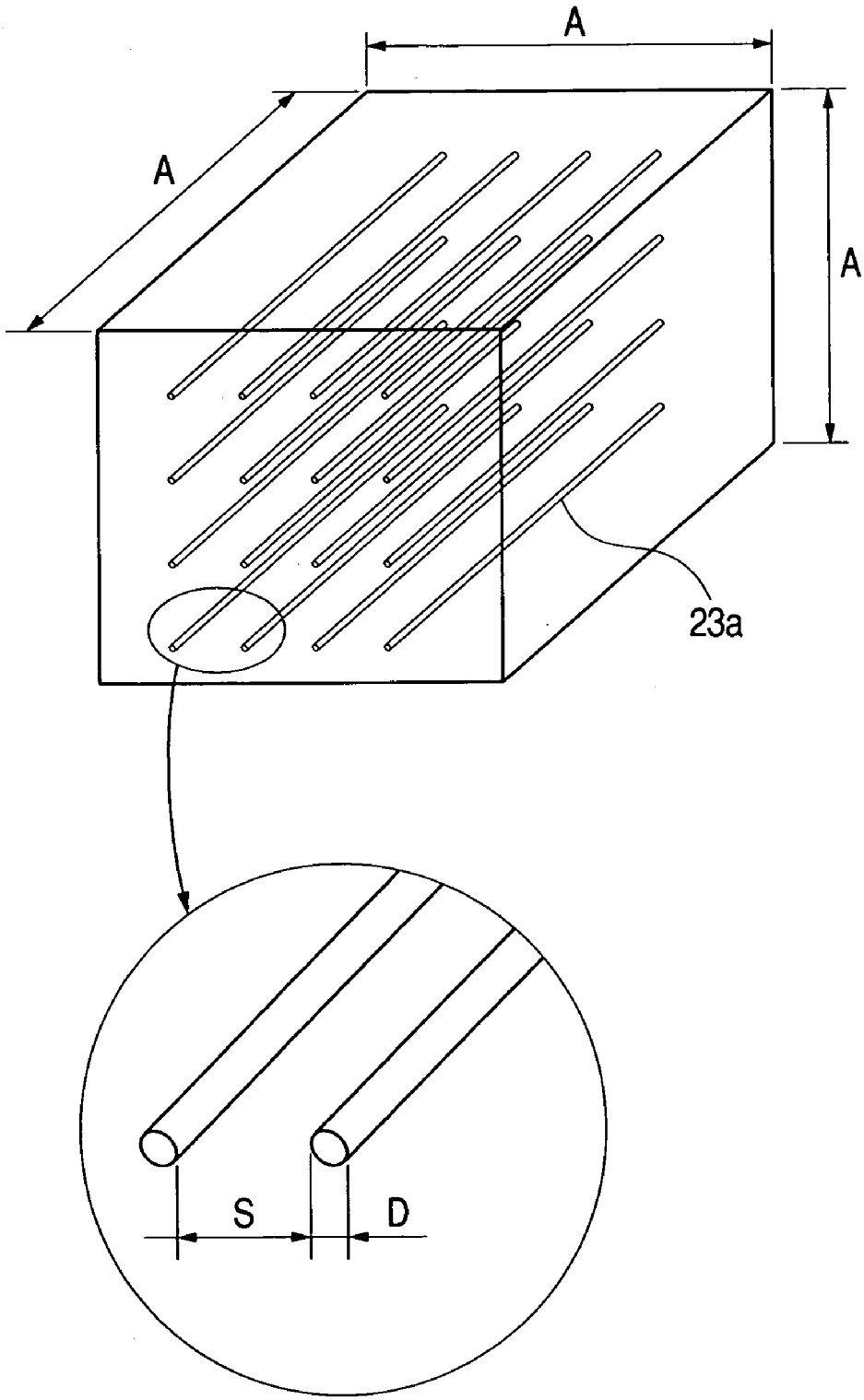
FIG. 2 is a pattern diagram illustrating a state that an ink absorber shown in FIG. 1 is cut out as a cube whose one side is A.

As shown in FIG. 2, the case where the fibers 23*a* are dispersed approximately uniformly in a cube whose one side is A mm is considered. When a length of the fibers 23*a* included in the cube is determined as L (mm) and its diameter is determined as D (mm), an average distance between fibers S (mm) can be expressed by the following equation (1).

[Equation (1)]

$$S = \frac{A}{\sqrt{L/A}} \cdot D \tag{1}$$

Figure 3:
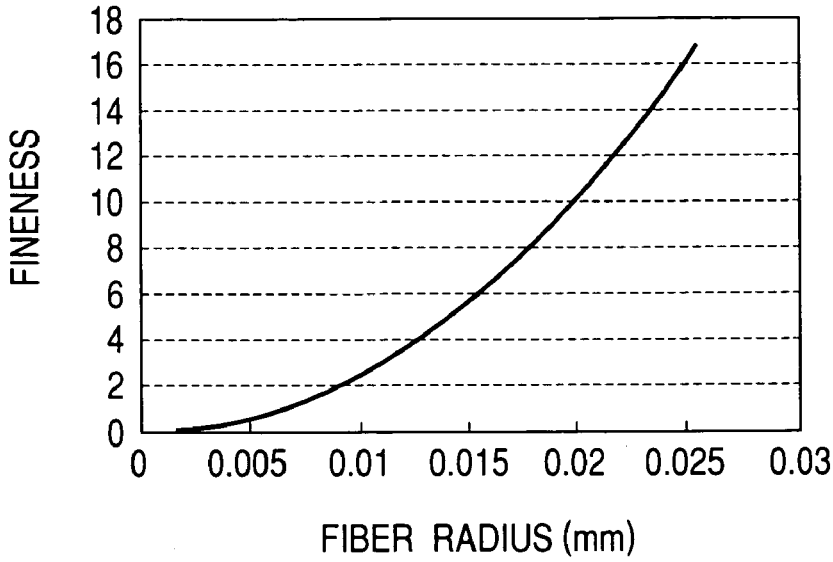
FIG. 3 is a graph illustrating a relationship between a fiber radius and fineness of polypropylene fiber.

In the equation (1), the length L of the fibers 23*a* can be obtained from the specific gravity, the fineness and the packaging density of the fibers 23*a*. Moreover, the diameter D of the fibers 23*a* can be obtained according to a graph in FIG. 3 illustrating a relationship between the fineness and a fiber radius in the polypropylene fibers in which ρ is 0.91. According to the graph of FIG. 3, since the radius of the polypropylene fibers whose fineness is 6 denier is 0.015 mm, the average distance between fibers S in this embodiment can be determined as 0.15 mm according to the equation (1). From the graph of FIG. 3, it is found that the radius of the fibers whose fineness is 2 to 7 denier (18 to 63 g/km) is 0.007 to 0.017 mm.

Incidentally, the polypropylene fibers which are used as the ink absorber in the ink tank of the prior ink jet recording apparatus by the inventors and the others have fineness of 6 denier, and they are packed with the packing density of 0.08 g per space of 1 $cm^3$. The average distance between fibers S in this case is 0.09 mm.

Figure 4:
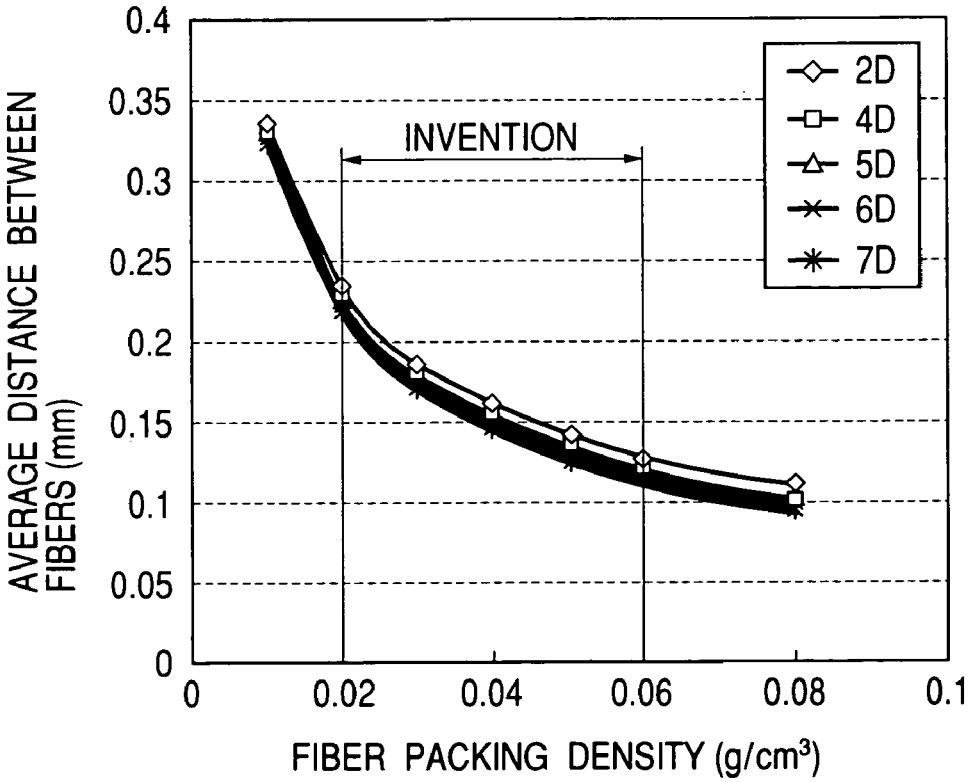
FIG. 4 is a graph illustrating a relationship between fiber density and an average diameter between fibers when the ink absorber is composed of the polypropylene fibers.

FIG. 4 is a graph illustrating a relationship between the packing density ($g/cm^3$) and the average distance between fibers expressed by the equation (1) where the fineness of the polypropylene fibers (ρ=0.91) used in this embodiment is used as a parameter. According to FIG. 4, the relationship between the average distance between fibers and the fiber packing density is such that they have the same tendency and values within a range of 2 to 7 denier (18 to 63 g/km). When the average distance between fibers is 0.012 to 0.025 mm, the fiber packing density is 0.02 to 0.06 ($g/cm^3$).

Figure 5:
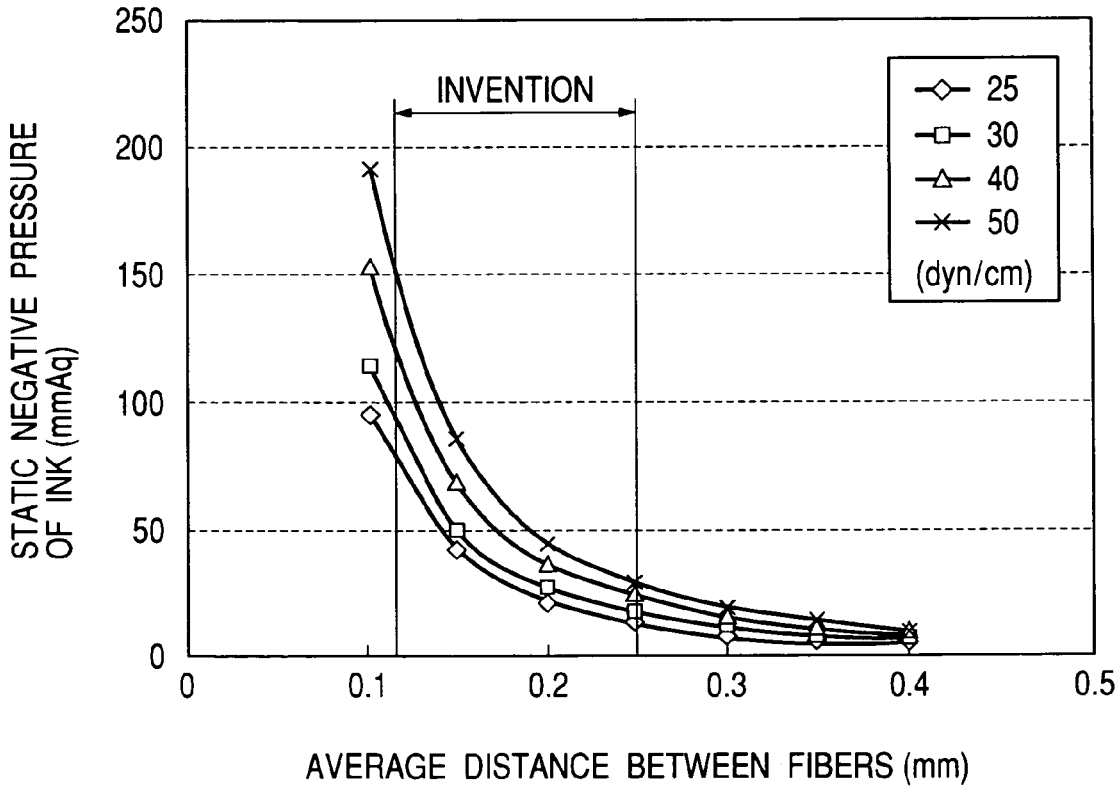
FIG. 5 is a graph illustrating a relationship between the average diameter between fibers and static negative pressure when the ink absorber is composed of the polypropylene fibers.

Further, FIG. 5 shows a graph of a relationship between the average distance between fibers and static negative pressure generated in the ink in which surface tension of the ink is used as a parameter. Various types of ink is used for the ink jet recording, and one of its physical properties is the surface tension. The smallest surface tension of the ink used for normal ink jet recording is 25 dyn/cm ($25\times10^{-5}$ N/cm), and the largest surface tension is 50 dyn/cm ($50\times10^{-5}$ N/cm).

According to FIG. 4, when the average distance between fibers is within the range of 0.12 mm to 0.25 mm, the fiber packing density is about 0.02 $g/cm^3$ to 0.06 $g/cm^3$. Moreover, according to FIG. 5, in the case the average distance between fibers is within the range of 0.12 mm to 0.25 mm, when the surface tension of the ink is within a range which is suitable for normal use of the ink jet recording, the static negative pressure generated in the ink is about 20 mmAq (196 Pa) to 150 mm Aq (1470 Pa). FIGS. 4 and 5 are data about the polypropylene fibers in which ρ=0.91, but the similar data can be obtained in the case of polyolefin resin.

The ink absorber 23 should have an ink holding force within a suitable range, which ink holding force depends on the static negative pressure. When the ink holding force is too weak, the ink spills out of the ink absorber 23 due to impact and vibration and occasionally leaks from the recording head 21. On the contrary, when the ink holding force is too strong, it is difficult to supply the ink from the ink absorber 23 to the recording head 21. As a result, the stable discharge becomes difficult.

As is clear from FIG. 5, when the average distance between fibers is less than 0.12 mm, the static negative pressure of the ink abruptly changes, and thus it is difficult to set the ink holding force within a suitable range. When the average distance between fibers exceeds 0.25 mm, the static negative pressure is less than 20 mmAq (196 Pa), and the ink holding force becomes too small. In the present invention, therefore, the average distance between fibers of the ink absorber 23 is 0.12 to 0.25 mm.

On the contrary in the prior art, the packing density of the ink absorber is 0.06 to 0.15 $g/cm^3$ and it is different from that in the present invention. The static negative pressure generated in the ink becomes, accordingly, 40 to 100 mmAq (392 to 980 Pa) in the case of the ink having the surface tension of 25 dyn/cm, and 80 to 200 mmAq (784 to 1960 Pa) in the case of the ink having the surface tension of 50 dyn/cm.

Table 1 shows results of measuring a supply quantity of the ink when the ink is supplied 2000 times in the case where the capacity of the ink to be packed into the sub tank 22 is 0.11 g and the packing density of the ink absorber is 0.04 $g/cm^3$ (this embodiment) and is 0.08 $g/cm^3$ (the prior art). At this time, the ink having the surface tension of 31 dyn/cm ($31\times10^{-5}$N/cm) and the viscosity of 1.9 cP (1.9 $mNs/m^2$) was used.

TABLE 1

| | Embodiment | Prior Art |
|---|---|---|
| Packing density of ink absorber | 0.04 $g/cm^3$ | 0.08 $g/cm^3$ |
| Average distance between fibers | 0.15 mm | 0.10 mm |
| Number of times of supply | | |
| Early time | 0.104 g | 0.10 g |
| 2000th time | 0.097 g | 0.072 g |
| Supply efficiency with respect to capacity of sub tank after 2000th supply | 88% | 65% |

As is clear from Table 1, when the packing density of the ink absorber is 0.08 $g/cm^3$, the supply efficiency after 2000th supply is 65%, namely, the supply efficiency is deteriorated greatly as compared with the early time. On the contrary, when the packing density of the ink absorber is 0.04 $g/cm^3$, the supply efficiency is 90% even after the 2000th supply, namely, the supply efficiency is hardly deteriorated. This is because when the packing density of the ink absorber is reduced, the average distance between fibers becomes large, and catch of bubbles at the time of the ink supply is reduced.

Table 2 shows results of measuring the negative pressure properties of the embodiment and the prior art.

TABLE 2

| | Embodiment | Prior art |
|---|---|---|
| Static negative pressure | 50 mmAq (490 Pa) | 100 mmAq (980 Pa) |
| Dynamic negative pressure 0.05 cc/sec | 90 mmAq (882 Pa) | 180 mmAq (1764 Pa) |

According to Table 2, in the embodiment, when the packing density of the ink absorber is reduced, the ink can be supplied to the recording head against low internal resistance with respect to large consumption of the ink from the recording head. This means that the ink can be discharged stably in high-speed recording. Meanwhile, the static negative pressure as basic negative pressure does not greatly change as compared with the prior art. The embodiment, therefore, has sufficient ink holding force as the ink absorber. The reason for this is that, as clear from FIG. 5, when the average distance between fibers is not less than 0.12 mm, a change in the static negative pressure is small, but when the average distance between fibers is less than 0.12 mm, the static negative pressure changes greatly.

When the ink absorber 23, whose average distance between fibers is within the range of 0.12 to 0.25 mm, is arranged in the sub tank 22, while the ink holding force necessary as the ink absorber 23 is being maintained, bubbles generated at the time of the ink supply to the sub tank 22 can be inhibited from being accumulated in the ink absorber 23. As a result, even if the supply of the ink from the main tank 31 to the sub tank is repeated, the ink holding ability of the ink absorber 23, in other words, the supply efficiency of the ink to the sub tank 22 is hardly deteriorated, and thus the ink can be supplied stably. Since, therefore a margin for the capacity of the sub tank 22 is minimum, the embodiment can contribute greatly to miniaturization of the carriage and further the miniaturization of the ink jet recording apparatus.

Such an ink jet recording apparatus is suitably applied to a minimum ink jet recording apparatus particularly such as a card-size printer for carrying out the recording onto a card-size medium to be recorded in which restriction on dimensions of the components is extremely strict. The embodiment exemplifies the case where the vapor-liquid separating film 25 is used in order to realize ink supply to the sub tank 22 with a very simple constitution. The present invention can be, however, applied to the case where not the vapor-liquid separating film 25 but a sensor (not shown), for detecting an ink quantity is arranged in the sub tank 22, and an quantity of ink supply to the sub tank 22 is controlled based on the detected result of the sensor.

Figure 6:
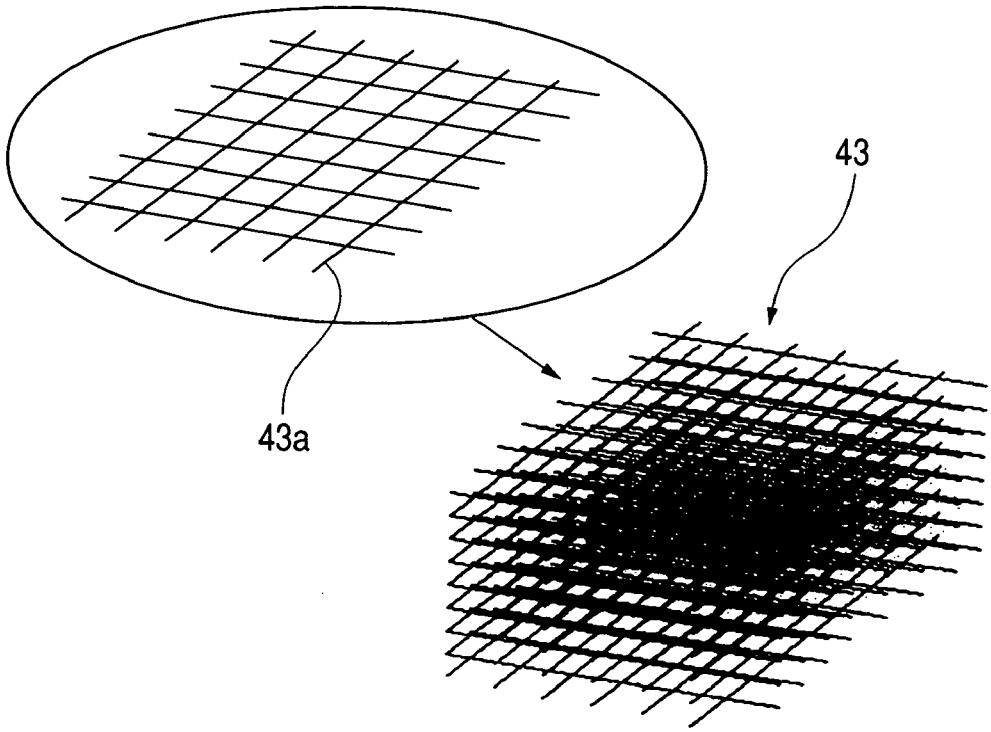
FIG. 6 is a pattern diagram of the ink absorber according to another embodiment of the present invention.
Figure 7:
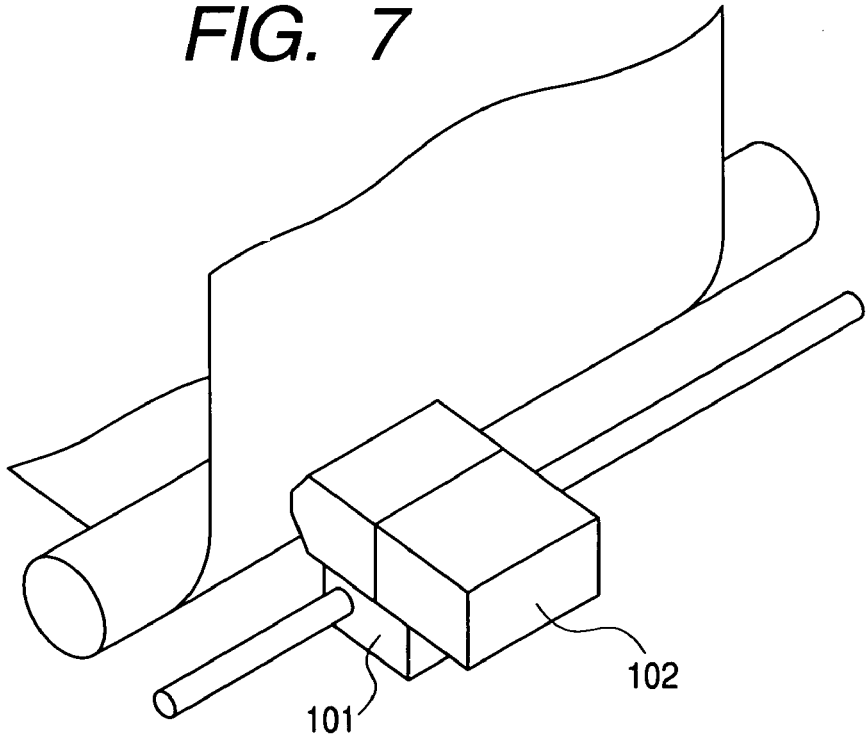
FIG. 7 is a schematic perspective view of the ink jet recording apparatus adopting a head tank on-carriage system.
Figure 8:
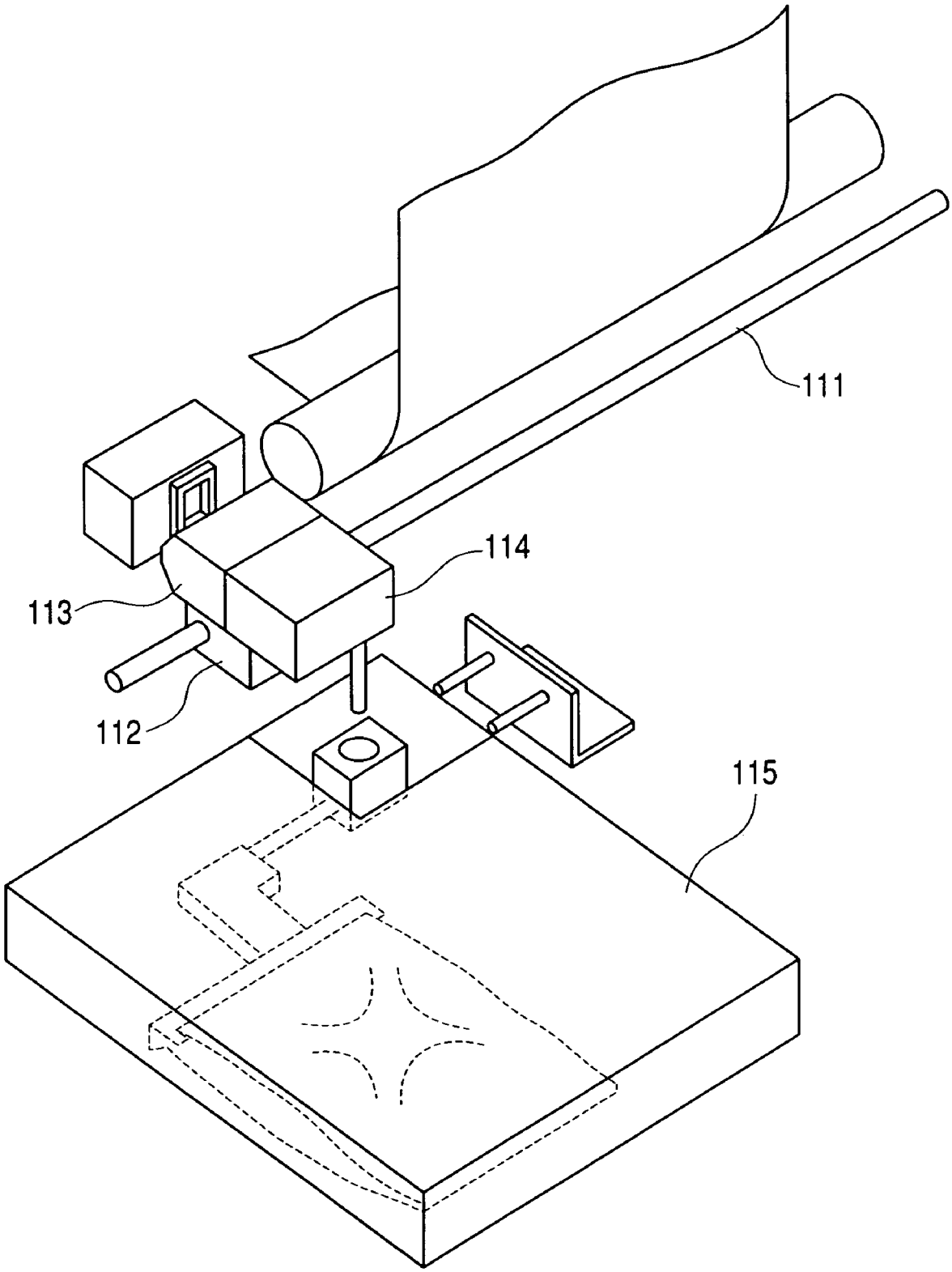
FIG. 8 is a schematic perspective view of the ink jet recording apparatus adopting a pit-in system.

FIG. 6 illustrates the ink absorber according to another embodiment of the present invention. The above-mentioned embodiment explains the fiber material as the ink absorber, but the ink absorber 43 shown in FIG. 6 is constituted so that mesh textures 43*a* in which fibers are woven uniformly are overlapped with each other. The ink absorber 43 is housed in the sub tank 22 shown in FIG. 1 so that the average distance between fibers becomes 0.12 to 0.25 mm. When such an uniform mesh constitution is provided, dispersion of the performance of the ink absorber 43 can be suppressed, and simultaneously generated falling-out property of bubbles can be improve.

In the present invention, the ink absorber can be composed of a porous material. That is to say, any members can be used as the ink absorber as long as they have a lot of cavities for holding the ink utilizing the surface tension of the ink. The ink absorber is arranged in the sub tank so that an average distance between cavities which is an average size of the cavities becomes 0.12 to 0.25 mm, thereby obtaining the above-mentioned effect.

According to the present invention, when the average distance between cavities of the ink absorber arranged in a first ink tank is set to be 0.12 mm to 0.25 mm, even if the ink supply from a second ink tank to the first ink tank is repeated, deterioration of the ink holding ability of the ink absorber is suppressed, thereby supplying the ink stably. As a result, a capacity of the first ink tank can be minimum, so that the carriage can be miniaturized. As a result, the ink jet recording apparatus can be miniaturized.

What is claimed is:

1. An ink jet recording apparatus, comprising:

a carriage equipped with a recording head for discharging ink and a first ink tank for housing ink to be supplied to the recording head; and a second ink tank which is arranged separately from the first ink tank and is connected with the first ink tank in order to supply the ink to the first ink tank, wherein an ink absorber having a lot of cavities for holding the ink is arranged in the first ink tank, and an average distance between cavities is 0.12 mm to 0.25 mm.

* * * * *